United States Patent [19]

Davis

[11] Patent Number: 4,795,332

[45] Date of Patent: Jan. 3, 1989

[54] TELESCOPIC PIVOTING SCREED

[75] Inventor: Donald E. Davis, Stockton, Calif.

[73] Assignee: Telescreed, Inc., Stockton, Calif.

[21] Appl. No.: 85,945

[22] Filed: Aug. 17, 1987

[51] Int. Cl.[4] ..... E04F 21/24; E01C 19/30

[52] U.S. Cl. ..... 425/60; 404/112; 404/114; 404/118; 425/456

[58] Field of Search ..... 425/60, 59, 62, 63, 425/456, 458; 404/114, 118, 119, 120, 112

[56] References Cited

U.S. PATENT DOCUMENTS

| | | | |
|---|---|---|---|
| 2,306,671 | 12/1942 | Tamblyn | 404/119 |
| 4,011,705 | 3/1977 | Vanderklaauw | 264/34 |
| 4,046,483 | 9/1977 | Sutherland | 404/112 |
| 4,105,355 | 8/1978 | King et al. | 404/118 |
| 4,298,555 | 11/1981 | Weltmer | 425/456 |
| 4,349,295 | 9/1982 | Morrison | 404/114 |
| 4,379,653 | 4/1983 | Brown | 404/118 |
| 4,379,683 | 4/1983 | Rodgers et al. | 425/62 |
| 4,397,626 | 8/1983 | Morrison | 425/64 |

*Primary Examiner*—Jay H. Woo
*Assistant Examiner*—James C. Housel
*Attorney, Agent, or Firm*—Harris Zimmerman; Howard Cohen

[57] ABSTRACT

A screed for forming the surface of a freshly poured concrete slab has parallel blades which are slidable relative to each other enabling extension and contraction of the screed during operation. The concrete surface is formed by pivoting movement of the screed around fixed pivot structure which supports and anchors one end of the screed. Vibrating mechanism may be included to tamp the concrete concurrently with the surface forming operation. The apparatus may be operated by a single person if necessary and the operator may extend and contract the screed during the pivoting movement in order to follow the outline of the concrete slab and/or to avoid interference from obstructions in the vicinity of the slab.

13 Claims, 4 Drawing Sheets

TELESCOPIC PIVOTING SCREED

TECHNICAL FIELD

This invention relates to apparatus for forming slab concrete and more particularly to screeds for leveling or grading the surface of uncured wet concrete.

BACKGROUND OF THE INVENTION

Freshly poured concrete usually requires leveling or grading with a screed or rod to provide a smooth surface at a desired level or grade. Tamping is also usually advisable to eliminate internal voids in the wet concrete. These operations are usually followed by floating and finishing to further refine the surface.

Conventional screeds have a blade long enough to span the entire concrete slab and are operated by a minimum of two persons who are stationed at opposite sides of the slab. The two operators synchronously travel their ends of the screed along the slab. One or more additional persons are required to scrape away excess material which accumulates in front of the advancing screed. Some more complex and costly screeds are motor driven but the duplication of effort is still essentially present as drive mechanism must be provided at both sides of the slab. It would be advantageous to reduce the number of personnel and/or complication of the mechanism that is required for such purposes.

A conventional screed of sufficient length to span large area slabs, such as building floors for example, becomes cumbersome and awkward if it must also be used on small area slabs or small extensions of a large slab. The screed may overlap such slabs for a substantial distance. The problem becomes particularly acute if there are obstacles or terrain variations in the vicinity of the slab. Use of an oversized screed may be difficult or impossible if there are upslopes, downslopes, trenches, walls, or piles of construction materials adjacent the slab.

Mismatch of the conventional screed with the slab area to be leveled can occur temporarily at certain stages only of a single operation if the area is angled or non-rectangular. The screed must, for example, temporarily span a greater distance while being turned at an angle in a slab than while being travelled along other portions of the slab. Slabs may also have extensions that are of less width than the main body of the slab. The effective working area of such a screed on a circular slab progresses from a minimum to a maximum and then back to the minimum.

Problems arising from excessive overhang of screeds with the work area can be alleviated to some extent under some conditions if a number of screeds of differing length are available. This is not always an effective solution, particularly on angled or non-rectangular slabs as discussed above, and at best requires a bulky and costly duplication of equipment.

Providing a number of screeds of different sizes is particularly disadvantageous in the case of vibrating screeds which include costly mechanism for accomplishing tamping concurrently with the leveling or grading operation. Transportation of a number of such mechanisms to and from a job site also adds significantly to costs.

The present invention is directed to overcoming one or more of the problems discussed above.

SUMMARY OF THE INVENTION

In one aspect, a screed embodying the invention includes first and second linear screed blade segments which are disposed in parallel relationship. Coupling means maintain the first and second screed blade segments in parallel relationship while enabling longitudinal sliding movement of the second blade segment relative to the first blade segment. Pivot means enable temporary anchoring of a predetermined portion of the first screed blade segment at a selected pivot axis while enabling pivoting movement of the screed about the axis.

In another aspect, the invention provides a screed for forming the surface of concrete or the like which includes first and second linear screed blade segments disposed in parallel relationship and which have coplanar undersurfaces. A pair of spaced apart linear rails extend in parallel relationship along the first screed blade segment and are secured to that segment. Spaced apart linear bearing members secured to the second screed blade segment engage the rails and are slidable along the rails. A pivot element is coupled to one end of the first screed blade segment by hinge means which enable tilting of the screed relative to the pivot element. An expendable bearing member, suitable for permanent emplacement at a site where the concrete is to be formed, has means for enabling temporary engagement of the pivot element with the bearing member to enable pivoting of the screed about a fixed vertical axis at the bearing member.

In still another aspect, the first and second screed blade segments each have hollow configurations and end closures. First and second motor driven vibrators are disposed within the first and second screed blade segments respectively.

A screed embodying the invention is extensible and contactable during operation and has one end supported and anchored at a pivot assembly within or near the freshly poured concrete which is to be formed. The other end may then be pivoted around the pivot assembly to level or grade the surface of the concrete. In a preferred form of the invention, both screed blade segments are hollow and contain vibrating mechanism enabling tamping of the concrete concurrently with the leveling or grading. Such screeds may be operated by a single person if necessary and the operator may extend and contract the screed during the pivoting movement in order to stay close to the boundary of the concrete slab and thereby avoid excessive overhang of the screed with the slab.

DETAILED DESCRIPTION OF THE PREFERRED EMBODIMENT

Figure 1:
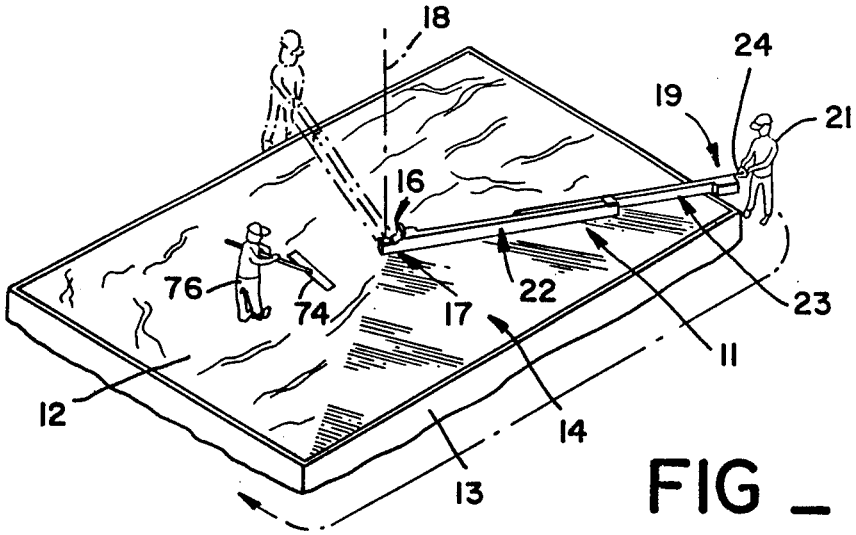
FIG. 1 is a perspective view of a concrete screed embodying the invention shown in the course of operation.

Referring initially to FIG. 1 of the drawings, a screed 11 in accordance with this embodiment of the invention may be used for leveling the surface of uncured concrete 12 which has been freshly poured into forms 13 that define the boundary of a concrete slab 14. Slab 14 is a rectangular floor for a building in this example although the screed 11 may also be used to form the surface of slabs having other configurations and which may be intended for other purposes.

Among those differences, screed 11 is distinct from the conventional construction in that disengagable pivot means 16 provide for temporary anchoring of an inner end 17 of the screed at a pivot axis 18 while enabling pivoting movement of the outer end 19 around the axis, the screed also being longitudinally extensible and contractable. Pivot axis 18 is usually vertical and typically located at a central region of slab 14 although other placements are possible as will hereinafter be discussed.

Leveling or grading of the slab 14 is accomplished by traveling the outer end portion 19 of screed 11 along the upper edge of forms 13 to sweep the screed along the surface of the slab in a pivoting movement about axis 18. The operator 21 may extend or contract the screed 11 in the course of such movement in order to remain close to forms 13 and to avoid problems with obstacles or sloping terrain in the vicinity of slab 14. The screed 11 is preferably vibrated during the pivoting movement in order to tamp the concrete 12 at the same time that it is being leveled, suitable vibrating mechanism for this purpose being hereinafter described.

Components of screed 11 include a primary arm 22 and a parallel extension arm 23 which is longitudinally slidable relative to the primary arm to enable the extension and contraction of the screed. The pivot means 16 is located at the inner end of primary arm 22 in this example and a hand grip 24 at the outer end of extension arm 23 facilitates manual pivoting of the arm and enables selective extension and contraction of the screed 11 in the course of such movement.

Figures 2, 3, 11, 12, 13, 15, 16:
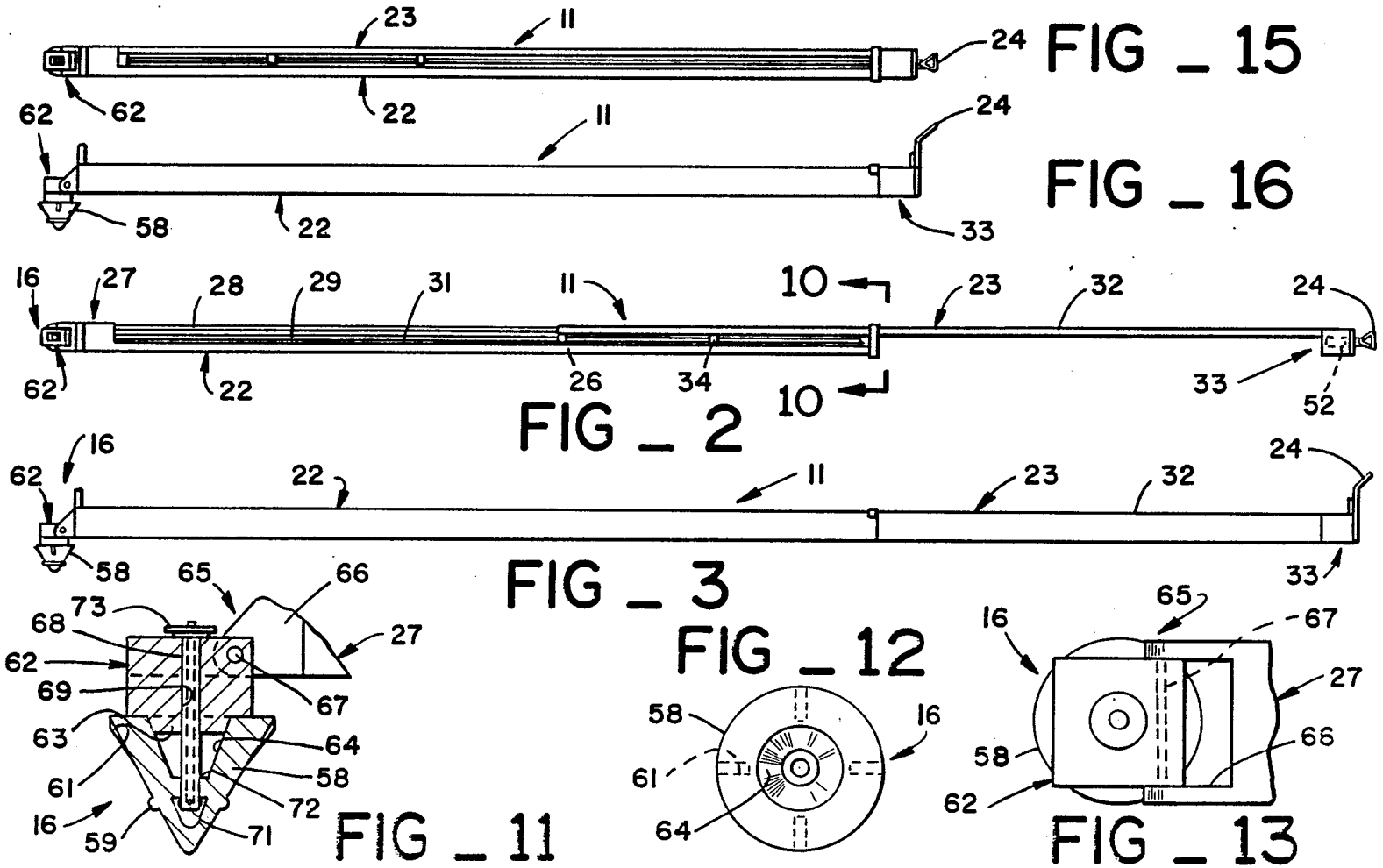
FIG. 2 is a plan view of the screed shown in an extended condition.
FIG. 3 is a side view of the extended screed of FIG. 2.
FIG. 11 is an elevation section view of pivot mechanism which is provided at one end of the screed.
FIG. 12 is a plan view of an expendable bearing member which is a component of the pivot mechanism of FIG. 11.
FIG. 13 is a plan view of the pivot mechanism of FIG. 11.
FIG. 15 is a top view of the screed shown in the contracted condition.
FIG. 16 is a side view of the screed shown in the contracted condition.

Referring now to FIGS. 2 and 3 in conjunction, the primary arm 22 includes a blade member 26 of hollow rectangular cross section which extends from a housing 27 adjacent the pivot means 16. Housing 27 is also of hollow rectangular configuration but has a greater width than blade 26. The undersurfaces of housing 27 and blade 26 are coplanar. A tube 28 extends from housing 27, in spaced apart parallel relationship with blade 26, to strengthen and rigidize the primary arm 22. A pair of vertically spaced apart rails 29 and 31 also extend from housing 27 in parallel relationship with blade 26, the rails being situated between the blade and tube 28.

The extension arm 23 also has a hollow rectangular blade member 32 extending from another housing 33 situated at the outer end of the extension arm. The hand grip 24 is secured to housing 33 and the tube 28 of the primary arm 22 extends into blade 32 of the extension arm 23. Blade 32 and housing 33 of the extension arm 23 may have configurations similar to those of the corresponding components 26 and 27 of the primary arm 22.

Figure 4:
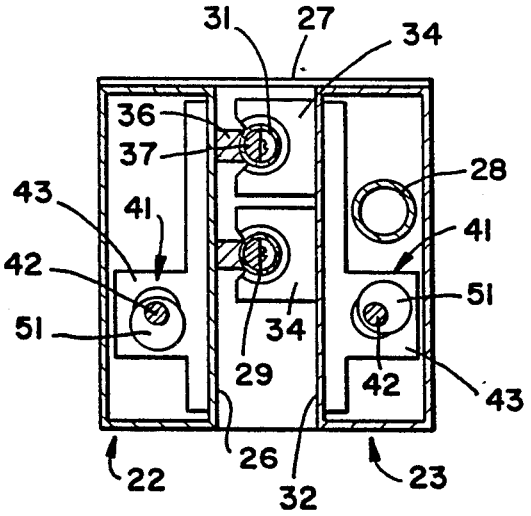
FIG. 4 is a first cross section view of the screed taken along line 4—4 of FIG. 6.

Referring to FIGS. 2 and 4 in conjunction, the primary arm 22 and extension arm 23 are joined together while being longitudinally slidable relative to each other by a series of spaced apart linear bearing blocks 34 which are secured to extension arm blade 32 and which engage the rails 29 and 31 of the primary arm.

Figure 5:
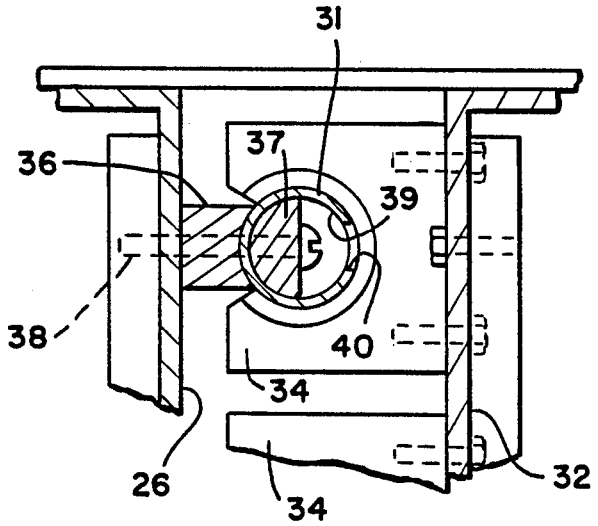
FIG. 5 is an enlarged view of the upper central portion of FIG. 4.

Rails 29 and 31 are tubular and each is supported by one of a pair of spacer members 36 which extends between the rail and primary arm blade 26 and which holds the rail in spaced apart relationship from the blade. A retainer member 37 of semicircular cross section extends within each rail 29 and 31. Referring to FIG. 5, bolts 38 extend sidewardly through retainer member 37 and spacer member 36 at intervals along the members to secure each rail 31 to primary arm blade 26. Openings 40 in the tubular rail 31 enable insertion and engagement of the bolt 38. Each bearing block 34 has a slot 39 of circular configuration which encloses somewhat more than 180° of the circumference of the associated rail 31 thereby preventing disengagement of the bearing blocks from the rails.

Figure 7:
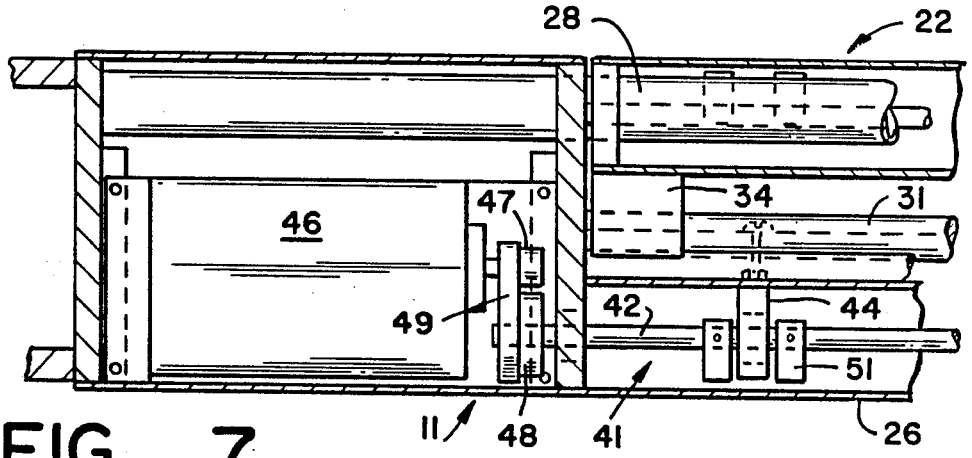
FIG. 7 is a plan section view of the portion of the apparatus shown in FIG. 6.
Figure 6:
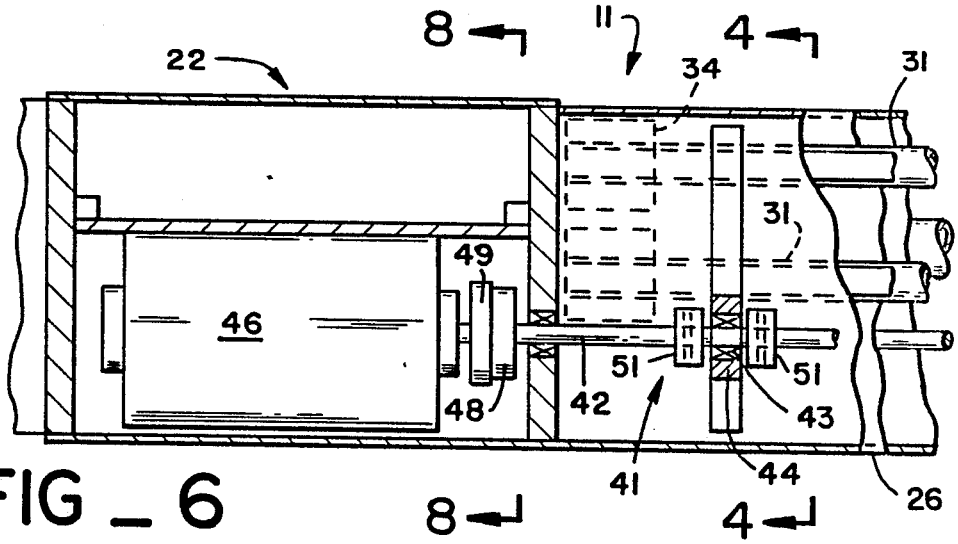
FIG. 6 is an elevation section view of one end of the screed.
Figure 8:
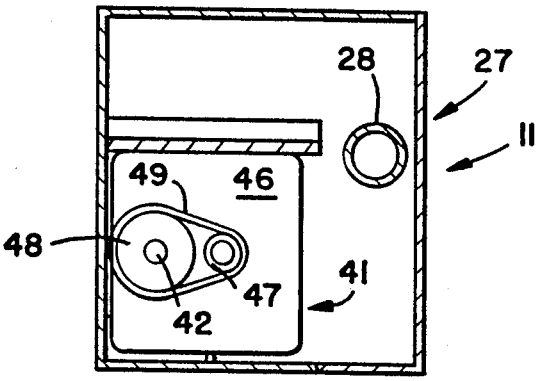
FIG. 8 is a cross section view taken along line 8—8 of FIG. 6.

Referring jointly to FIGS. 6, 7 and 8, means 41 are provided for vibrating and screed 11 in order to tamp concrete concurrently with the leveling or grading operation. The vibrating means 41 within primary arm 22 includes a rotatable shaft 42 extending along the length of the primary arm within blade 26 and which is supported and journaled for rotation by bearing 43 in support plates 44 which are spaced along the length of the blade. Shaft 42 is driven by an electrical motor 46 situated within housing 27 and which is coupled to the shaft through speed reduction gears 47 and 48. A belt 49 transmits drive from the output gear 47 of motor 46 to the larger diameter gear 48 on the end of shaft 42.

Figure 9:
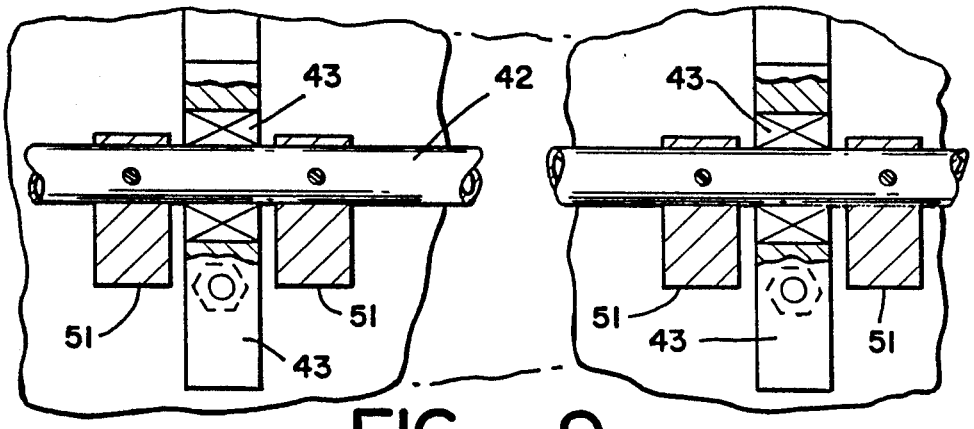
FIG. 9 is an enlarged and foreshortened view of vibrating mechanism which is depicted in part and on a smaller scale in FIG. 6.

Referring to FIGS. 4 and 9 in conjunction, a series of spaced apart circular weights 51 are secured to shaft 42 in eccentric relationship to the shaft, one of the weights being located at each side of each of the support plates 43 in this example. Rotation of the shaft 42 and weights 51 creates vibration throughout the primary arm 22 because of the unbalanced eccentric positioning of the weights on the shaft.

Figure 10:
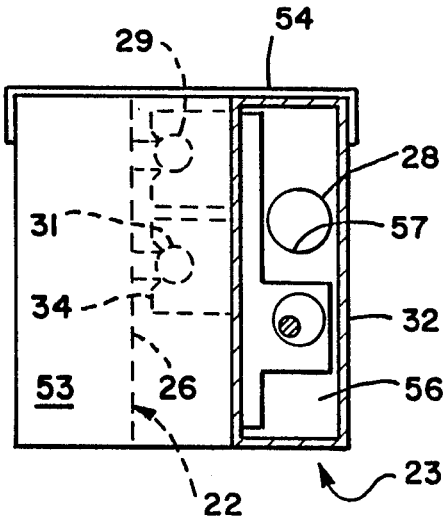
FIG. 10 is a cross section view of the screed taken along line 10—10 of FIG. 2.

Similar vibrating means 41, including eccentric weights 51 on a rotary shaft 42, are provided within the extension arm blade 32. The drive motor 52 for the vibrating means 41 of the extension arm 23 is situated within the housing 33 of that arm as shown in FIG. 2. Referring to FIG. 10, an end plate 53 on the primary arm 22 blocks entry of concrete into the primary arm blade 26 and the region of rails 29 and 31 and bearing blocks 34. A wiper 54 of inverted U shape is secured to the end of the primary arm 22 and extends across the top of the extension arm blade 32 to scrape any accumulated concrete from the top of extension arm blade when the screed 11 is being contracted. Extension arm 23 also has an end plate 56 for similar purpose, the end plate being provided with an opening 57 into which the end portion of strengthener tube 28 extends to support the outer end of the tube.

Referring jointly to FIGS. 11, 12 and 13, the pivot means 16 which enables rotary motion of the screed 11 about a fixed axis by a single operator if necessary includes an expendable pivot bearing 58 which may be left the concrete slab as will hereinafter be discussed in more detail. Pivot bearing 58 has a hollow conical configuration in this example, although other configurations are also possible, and is implanted in the concrete in an inverted orientation. An annular flange like protuberance 59 on the bearing 58 prevents lifting of the bearing from hardened concrete and vertical slots 61 in the bearing sidewall prevent rotation of the bearing when it is set in the concrete.

Bearing 58 receives the lower end of a pivot block 62 which has a circular projection 63 at the lower end that conforms with the upper portion of the conical cavity 64 of the bearing. Pivot block 62 is fastened to the housing 27 of primary arm 22 by means 65 which enable pivoting movement of the primary arm relative to the pivot block and bearing 58 about a horizontal axis. In particular, a pair of spaced apart brackets 66 extend from housing 27 along opposite sides of the upper end of the pivot block 62 and the arms and pivot block are transpierced by a hinge pin 67 which defines the horizontal pivot axis.

Prior to operation, a latching pin 68 is inserted into a vertical bore 69 in pivot block 62 and extends downward into the cavity 64 of the bearing 58 to assure retention of the pivot block in the bearing. Latching pin 68 has resilient detent projections 71 at the lower end which extend outward a small distance below an annular lip 72 in bearing cavity 64 after the pin has been forced through the lip. Thus the detent projections 71 resist withdrawal of the pin 68 and pivot block 62 form bearing 58 but enable such withdrawal if sufficient lifting force is applied. A flange 73 at the upper end of the latching pin 68 enables application of such lifting force by raising of the housing 27 end of the screed.

In operation, pivot bearing 58 is initially separate from the other portions of the apparatus and is emplaced at the site where concrete is to be laid in advance of the pouring of the main body of concrete. A relatively small mound of wet concrete is deposited at the site and the bearing 58 is seated into the top of the wet mound which is then allowed to hardened before pouring of the main body of concrete proceeds. Prior to or after pouring of the main body of concrete, the pivot block 62 is seated in bearing 58 and latching pin 68 is inserted.

Referring again to FIG. 1, the screed operator 21 levels and tamps the freshly poured concrete 12 by positioning the outer end of extension arm 23 on forms 13 and then traveling the outer end around the forms to pivot the screed 11 through at least 360° of rotation. Excess concrete 12 which accumulates at the screed 11 in the course of the pivoting movement may be scraped away with a suitable hand tool 74 either by another person 76 or, if necessary, by the screed operator 21 who may temporarily interrupt the leveling operation at intervals for the purpose.

Operator 21 may extend and contract the screed 11 during the course of the pivoting movement, by pulling or pushing on hand grip 24, to accomodate to the configuration of the forms 13 and to avoid interference from obstacles which may be present in the vicinity of the forms. At the conclusion of the leveling and tamping operation, the pivot means is disengaged by drawing hand grip 24 a distance outward from forms 13 and then pushing the hand grip down to pry the inner end of primary arm 22 upwardly using the forms as a fulcrum. Referring again to FIG. 11, the expendable pivot bearing 58 remains in the concrete and may be filled and covered with additional concrete or other material after the concrete slab has hardened.

Figure 14:
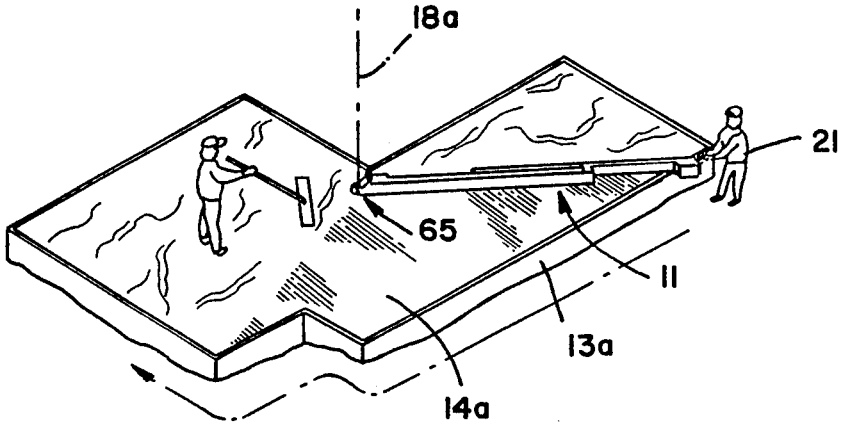
FIG. 14 is a perspective view of the screed shown in use on a concrete slab having a different configuration from the slab shown in FIG. 1.

Referring again to FIG. 1, operation of the screed 11 has been described for purposes of example with reference to the forming of a sizable concrete slab 14 of rectangular configuration and in which the pivot axis 18 is established at the center of the slab. As depicted in FIG. 14, the screed 11 may also be used to form slabs **14*a* of different configuration and different placements of the pivot axis 18*a* may be appropriate in such cases. The pivot axis 18*a* may in fact be situated outside of the slab 14*a* under some circumstances such as where the largest dimension of the concrete slab to be laid is smaller than the length of the screed 11. Pivoting of the screed 11** through a full turn may not be necessary under such circumstances.

The operation of the screed 11 has also been described with reference to leveling and tamping concrete slabs **14*a* which have flat strictly horizontal surfaces. The screed 11 may also be used to grade concave slabs having a surface which slopes down from the rim towards a central low point or convex slabs having a conical surface which rises towards a central high point. Hinge means 65 enable the screed 11** to be tilted upwardly or downwardly during operation for such purposes.

In addition to the above described operational advantages, a screed 11 which can be shifted between the extended configuration depicted in FIGS. 2 and 3 and the contracted configuration shown in FIGS. 15 and 16 is more convenient to transport to and from a job site and occupies less space when it is stored. Ease of handling is also facilitated if the major components of the screed 11 are constructed of light weight materials such as aluminum although this is not essential in all cases.

While the invention has been described with respect to a single preferred embodiment for purposes of example, many variations in the structure are possible and it is not intended to limit the invention except as defined in the following claims.

I claim:

1. A screed for forming the surface of cementitious material, the screed comprising:

first and second linear screed blade segments disposed in parallel relationship and having coplanar undersurfaces, a pair of spaced apart linear rails extending along said first screed blade segment in parallel relationship therewith and being secured thereto, a plurality of spaced apart linear bearing members secured to said second screed blade segment and being engaged on said rails for sliding movement therealong, a pivot element located at one end of said first screed blade segment, hinge means for coupling said first screed blade segment to said pivot element while enabling tilting of said screed relative to said pivot element, and an expendable bearing member suitable for permanent emplacement at the site where said cementitious material is to be formed, said being member having means for enabling temporary engagement of said pivot element therewith to enable pivoting of said screed about a fixed vertical axis defined by said bearing member.

2. The screed of claim 1 wherein said first and second screed blade segments each have a hollow rectangular configuration and have end closures, further including first and second motor driven vibrators disposed within said first and second screed blade segments respectively.

3. A screed for forming the surface of a slab of freshly poured cementitious material, the screed comprising:

first and second linear screed blade segments disposed in parallel relationship, coupling means for maintaining said first and second screed blade segments in parallel relationship while enabling longitudinal sliding movement of said second blade segment relative to said first blade segment, pivot means for temporarily anchoring a predetermined portion of said first screed blade segment at a selected pivot axis while enabling pivoting movement of said screed about said axis, said pivot means being fastened to said first screed blade segment by hinge means having a hinge axis which is transverse to said first screed blade segment.

4. The apparatus of claim 3 further including disengagable means for resisting separation of said pivot element from said expendable pivot bearing member.

5. The apparatus of claim 3 wherein said expendable pivot bearing member includes means for preventing rotation of said member in said concrete and for preventing withdrawal of said member from said concrete.

6. The apparatus of claim 3 wherein said coupling means includes at least one linear rail secured to one of said screed blade segments in parallel relationship therewith, and a plurality of spaced apart linear bearing members secured to the other of said screed blade segments, said linear bearing members being engaged on said rail and being slidable therealong.

7. The apparatus of claim 3 wherein said first and second linear screed blade segments each have a hollow tubular configuration.

8. The apparatus of claim 7 further including first and second vibrators disposed within said first and second screed blade segments respectively.

9. The apparatus of claim 8 wherein said first screed blade segment includes a first motor housing having a greater width than the remainder of said first screed blade segment and having an undersurface which is coplanar with the under surface of said remainder of said first screed blade segment, and wherein said second screed blade segment includes a second motor housing having a greater width than the remainder of said second screed blade segment and having an undersurface with is coplanar with the undersurface of said remainder of said second screed blade segment, wherein said first vibrator includes a first drive motor in said first motor housing, a first rotary shaft extending within said first screed blade segment and being coupled to said first drive motor for rotation thereby, and a first plurality of spaced apart weights secured to said first rotary shaft in eccentric relationship therewith, and wherein said second vibrator includes a second drive motor in said second motor housing, a second rotary shaft extending within said second screed blade segment and being coupled to said second drive motor for rotation thereby, and a second plurality of spaced apart weights secured to said second rotary shaft in eccentric relationship therewith.

10. The apparatus of claim 9 wherein said first and second motor housings are at opposite ends of said first and second screed blade segments respectively.

11. A screed for forming the surface of a slab of freshly poured cementitious material, the screed comprising:

first and second linear screed blade segments disposed in parallel relationship, coupling means for maintaining said first and second screed blade segments in parallel relationship while enabling longitudinal sliding movement of said second blade segment relative to said first blade segment, pivot means for temporarily anchoring a predetermined portion of said first screed blade segment at a selected pivot axis while enabling pivoting movement of said screed about said axis, said pivot means including a pivot element hinged to a first end of said first screed blade segment, and an expendable bearing member having an internal cavity with an opening at the top proportioned to receive at least a portion of said pivot element.

12. A screed for forming the surface of a slab of freshly poured cementitious material, the screed comprising:

first and second linear screed blade segments disposed in parallel relationship, coupling means for maintaining said first and second screed blade segments in parallel relationship while enabling longitudinal sliding movement of said second blade segment relative to said first blade segment, pivot means for temporarily anchoring a predetermined portion of said first screed blade segment at a selected pivot axis while enabling pivoting movement of said screed about said axis, said pivot means including a pivot element fastened to first screed blade segment and an expendable bearing member having an internal cavity with an opening at the top proportioned to receive at least a portion of said pivot element, at least an upper portion of said internal cavity of said expendable bearing member being annular and of progressively decreasing diameter in the downward direction and wherein said pivot element has a lower portion with a configuration which conforms to that of said upper portion of said internal cavity of said expendable bearing member.

13. A screed for forming the surface of a slab of freshly poured cementitious material, the screed comprising:

first and second linear screed blade segments disposed in parallel relationship, coupling means for maintaining said first and second screed blade segments in parallel relationship while enabling longitudinal sliding movement of said second blade segment relative to said first blade segment, pivot means for temporarily anchoring a predetermined portion of said first screed blade segment at a selected pivot axis while enabling pivoting movement of said screed about said axis, said pivot means including a pivot element fastened to said first screed blade segment and an expendable bearing member having an internal cavity with an opening at the top proportioned to receive at least a portion of said pivot element, said pivot element including a vertical bore extending therethrough and wherein said expendable bearing member has a radially extending lip within said internal cavity, further including a latching pin extending through said bore of said pivot element and into said internal cavity of said expendable bearing member and having at least one retractable detent which extends outward from said pin below said lip.

* * * * *